US011333148B2

(12) United States Patent
Kubota et al.

(10) Patent No.: US 11,333,148 B2
(45) Date of Patent: May 17, 2022

(54) SCREW COMPRESSOR AND REFRIGERATION DEVICE

(71) Applicant: MAYEKAWA MFG. CO., LTD., Tokyo (JP)

(72) Inventors: Yoshifusa Kubota, Tokyo (JP); Takayuki Kishi, Tokyo (JP); Keiji Kitahara, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 253 days.

(21) Appl. No.: 16/609,303

(22) PCT Filed: Oct. 9, 2018

(86) PCT No.: PCT/JP2018/037551
§ 371 (c)(1),
(2) Date: Oct. 29, 2019

(87) PCT Pub. No.: WO2020/075220
PCT Pub. Date: Apr. 16, 2020

(65) Prior Publication Data

US 2021/0332819 A1 Oct. 28, 2021

(51) Int. Cl.
*F04C 18/16* (2006.01)
*F04C 29/12* (2006.01)

(52) U.S. Cl.
CPC ..... *F04C 18/16* (2013.01); *F04C 29/12* (2013.01)

(58) Field of Classification Search
CPC ..... F04C 18/16; F04C 28/12; F04C 28/26; F04C 29/02; F04C 29/12; F04C 29/0014; F25B 1/047
See application file for complete search history.

(56) References Cited

U.S. PATENT DOCUMENTS 4,025,244 A 5/1977 Sato
4,940,394 A * 7/1990 Gibbons ..... F01C 21/102 417/283

(Continued)

FOREIGN PATENT DOCUMENTS

EP 3006740 A1 4/2016
EP 3505765 A1 7/2019

(Continued)

OTHER PUBLICATIONS

English translation of International Search Report issued in Intl. Appln. No. PCT/JP2018/037551 dated Jan. 8, 2019, previously cited in IDS filed Oct. 29, 2019.

(Continued)

*Primary Examiner* — Audrey B. Walter
*Assistant Examiner* — Dapinder Singh
(74) *Attorney, Agent, or Firm* — Rossi, Kimms & McDowell LLP

(57) ABSTRACT

A screw compressor according to an embodiment includes a rotor casing, a pair of screw rotors disposed in the rotor casing and engaging with each other, and a movable portion disposed so as to be movable in a rotor shaft direction of the pair of screw rotors. The movable portion includes liquefied liquid supply ports capable of supplying a liquefied liquid of a compressed gas toward tooth groove spaces formed by the pair of screw rotors.

16 Claims, 6 Drawing Sheets

(56) References Cited

U.S. PATENT DOCUMENTS

| | | | | |
|---|---|---|---|---|
| 7,074,018 | B2 * | 7/2006 | Chang | F04C 15/0061 417/410.3 |
| 7,150,611 | B2 * | 12/2006 | Perna | F01C 1/084 418/201.1 |
| 7,993,118 | B2 * | 8/2011 | Prior | F04C 29/04 418/91 |
| 2010/0229595 | A1 | 9/2010 | Gotou | |
| 2015/0093273 | A1 * | 4/2015 | Johnson | F04C 28/08 418/1 |
| 2018/0356139 | A1 * | 12/2018 | Johnson | F04B 49/065 |

FOREIGN PATENT DOCUMENTS

| | | | |
|---|---|---|---|
| JP | S57038692 | A | 3/1982 |
| JP | S6325255 | B2 | 5/1988 |
| JP | H0379959 | A | 4/1991 |
| JP | 2018021494 | A | 2/2018 |
| JP | 2018035782 | A | 3/2018 |
| WO | 2008153061 | A1 | 12/2008 |
| WO | 2014192898 | A1 | 12/2014 |
| WO | 2018037469 | A1 | 3/2018 |

OTHER PUBLICATIONS

English translation of Written Opinion issued in Intl. Appln. No. PCT/JP2018/037551 dated Jan. 8, 2019, previously cited in IDS filed Oct. 29, 2019.

International Search Report issued in Intl. Appln. No. PCT/JP2018/037551 dated Jan. 8, 2019.

Written Opinion issued in Intl. Appln. No. PCT/JP2018/037551 dated Jan. 8, 2019.

Extended European Search Report issued in European Application No. 18918417.9 dated Mar. 27, 2020.

* cited by examiner

SCREW COMPRESSOR AND REFRIGERATION DEVICE

TECHNICAL FIELD

The present disclosure relates to a screw compressor and a refrigeration device including the screw compressor.

BACKGROUND

In a refrigeration device including a screw compressor and constituting a refrigeration cycle, a liquid injection mechanism is known which injects a refrigerant liquid liquefied by a condenser from a hole disposed in a casing to a compression space and controls the temperature of a refrigerant gas discharged from the screw compressor. Patent Documents 1 and 2 each disclose a screw compressor having the above liquid injection mechanism.

CITATION LIST

Patent Literature

Patent Document 1: JPS63-025255B
Patent Document 2: JPH03-079959A

SUMMARY

Technical Problem

Although a liquid injection mechanism is used to decrease a discharge temperature, a refrigerant liquid evaporates by removing heat of a compressed gas under compression, bringing a disadvantage that an extra work to compress the evaporated gas to a discharge pressure is needed. In order to reduce the disadvantage, a liquid can be injected at a position close to a position where the discharge pressure is obtained. However, in a conventional liquid injection mechanism, an injection position of the refrigerant liquid in a screw compressor is fixed. Therefore, in a case in which a liquid is injected with a conventional fixed liquid injection port, the liquid injection port is connected to a discharge portion, disabling liquid injection if an internal volume ratio (Vi) adjusting valve moves to a low internal volume ratio side (suction side), or a pressure of a compression space adjacent to the injection port is decreased, and thus may result in the refrigerant liquid being injected excessively if the internal volume ratio (Vi) adjusting valve moves to a high internal volume ratio side (discharge side) to handle a situation where a suction pressure decreases. Consequently, the temperature of a discharge gas may become unstable, degrading performance and reliability of the screw compressor.

Moreover, in the case of a screw compressor incorporating an unloader slide valve and performing volume control, against a required liquid injection amount which decreases upon unload in the fixed liquid injection port, a liquid supply amount of a flow-rate adjusting valve instantly increases upon a decrease in the pressure of the compression space adjacent to the liquid injection port. As a result, a liquid may excessively be supplied. In addition, if the unloader slide valve moves to the suction side, the liquid injection port is connected to the discharge portion, which may produce undesirable phenomenons such as an increase in compression power, a rise in internal pressure, an increase in bearing load, and an increase in compressor vibration. Consequently, problems such as an unstable discharge temperature, and degradation in performance and a decrease in life of the compressor may arise.

Furthermore, repeating such operations, durability of a liquid supply control valve disposed on a liquid injection line may be deteriorated.

An object of an embodiment is to improve a coefficient of performance (COP) and to improve reliability of the compressor by enabling stable control of the temperature of the refrigerant gas discharged from a screw compressor having a liquid injection function even if operating conditions change in the screw compressor.

Solution to Problem (1) A screw compressor according to an embodiment includes a rotor casing, a pair of screw rotors disposed in the rotor casing and engaging with each other, and a movable portion disposed so as to be movable in a rotor shaft direction of the pair of screw rotors. The movable portion includes liquefied liquid supply ports capable of supplying a liquefied liquid of a compressed gas toward tooth groove spaces formed by the pair of screw rotors.

The tooth groove spaces are a plurality of enclosed spaces formed between a pair of male and female screw rotors engaging with each other inside the rotor casing, and gradually decrease in volume as the tooth groove spaces move to a discharge side. Consequently, a refrigerant gas in the tooth groove spaces is increased in pressure and discharged from a discharge port.

With the above configuration (1), since the above-described liquefied liquid supply ports can move in the rotor shaft direction with the movable portion, it is possible to stably control the temperature of the refrigerant gas discharged from the screw compressor (to be also referred to as a "discharge gas temperature" hereinafter) by adjusting positions of the liquefied liquid supply ports in the rotor shaft direction even if operating conditions change. In addition, since the movable portion is provided with the liquefied liquid supply ports, it is possible to arrange the liquefied liquid supply ports such that they communicate with tooth groove spaces on a side which is close to the discharge port and has a high pressure. Thus, it is possible to efficiently decrease the discharge gas temperature and to reduce a workload of the compressor as compared with a case in which a liquid is injected on a side close to a suction port.

(2) In an embodiment, in the above configuration (1), the movable portion internally forms a cavity, and the liquefied liquid supply ports communicate with the cavity and are formed by through holes opening to an outer peripheral surface of the movable portion.

With the above configuration (2), since a supply passage for a refrigerant liquid supplied to the liquefied liquid supply ports is formed inside the movable portion, it is possible to downsize the configuration of the refrigerant liquid supply passage. Moreover, since the liquefied liquid supply ports are formed by the through holes opening to the outer peripheral surface of the movable portion, it is possible to simplify the configuration of each of the liquefied liquid supply ports.

(3) In an embodiment, in the above configuration (2), the movable portion includes an extending portion extending outside the rotor casing in the rotor shaft direction, the screw compressor further includes a drive portion driving the movable portion via the extending portion in the rotor shaft direction, and the extending portion internally forms a liquefied liquid introduction space communicating with the cavity and linearly extending in the rotor shaft direction.

With the above configuration (3), since it is possible to introduce the liquefied liquid to the above-described cavity via the liquefied liquid introduction space formed in the above-described extending portion, it is possible to simplify the configuration of a liquefied liquid introduction path.

(4) In an embodiment, in any one of the above configurations (1) to (3), the screw compressor further includes an internal volume ratio variable control valve capable of controlling an internal volume ratio of the compressed gas sucked into the rotor casing, and the movable portion is constituted by a valve body of the internal volume ratio variable control valve.

With the above configuration (4), since it is possible to use the existing internal volume ratio variable control valve as the movable portion, it is unnecessary to install an additional movable portion. Moreover, the liquefied liquid supply ports are disposed on the valve body of the internal volume ratio variable control valve, making it possible to set the liquefied liquid supply ports at positions in the rotor shaft direction with the relatively high internal volume ratio having a less influence on compressor performance while the valve body is set with the optimum internal volume ratio depending on the operating conditions. Thus, it is possible to stably control the discharge gas temperature while suppressing the degradation in the compressor performance and to improve a cooling effect of the compressed gas.

(5) In an embodiment, in any one of the above configurations (1) to (3), the screw compressor further includes a volume control slide valve, and the movable portion is constituted by a valve body of the volume control slide valve.

With the above configuration (5), since it is possible to use the existing volume control slide valve as the movable portion, it is unnecessary to install an additional movable portion. Moreover, the liquefied liquid supply ports are formed in the valve body of the internal volume ratio variable control valve, making it possible to set the liquefied liquid supply ports at discharge-side positions having the less influence on the compressor performance in the rotor shaft direction while the valve body is set at an optimum position for volume control depending on the operating conditions. Thus, it is possible to stably control the discharge gas temperature while suppressing the degradation in the compressor performance and to improve the cooling effect of the compressed gas.

(6) In an embodiment, in any one of the above configurations (1) to (5), the plurality of liquefied liquid supply ports are arranged in the rotor shaft direction.

With the above configuration (6), since the liquefied liquid is injected from a plurality of parts dispersed in the rotor shaft direction, it is possible to ensure a necessary liquid supply amount and to uniformly cool the compressed gas in the rotor shaft direction. Moreover, impact waves such as liquid hammers generated by injecting the liquefied liquid are dispersed, making it possible to mitigate an impact force thereof. It is also possible to maintain a liquid injection function even if some of the liquefied liquid supply ports are clogged.

(7) In an embodiment, in the above configuration (6), the plurality of liquefied liquid supply ports are arranged toward at least a pre-discharge tooth groove space and a tooth groove space adjacent to the pre-discharge tooth groove space of the plurality of tooth groove spaces formed by the pair of screw rotors.

With the above configuration (7), since it is possible to inject the liquefied liquid into each tooth groove space closest to the discharge port of the plurality of tooth groove spaces, it is possible to control the discharge gas temperature more stably and to improve the cooling effect of the compressed gas.

(8) A refrigeration device according to an embodiment includes a refrigerant circulation line, a refrigeration cycle constituting device including the screw compressor according to any one of the above configurations (1) to (7) and a condenser disposed on the refrigerant circulation line, and a refrigerant liquid supply line supplying a refrigerant liquid liquefied by the condenser to the movable portion.

With the above configuration (8), since the refrigeration device includes the screw compressor having the above configuration, it is possible to stably control the discharge gas temperature and to arrange the liquefied liquid supply ports to the tooth groove spaces on the side which is close to the discharge port and has the high pressure even if the operating conditions change. Thus, it is possible to efficiently decrease the discharge gas temperature and to reduce the workload of the compressor as compared with the case in which the liquid is injected on the side close to the suction port.

(9) In an embodiment, in the above configuration (8), the movable portion is constituted by a valve body of an internal volume ratio variable control valve capable of controlling an internal volume ratio of a refrigerant gas sucked into the rotor casing, and the refrigeration device further includes a temperature sensor detecting a temperature of a refrigerant gas discharged from the screw compressor, a flow-rate adjusting valve disposed on the refrigerant liquid supply line, and a first controller controlling an opening degree of the flow-rate adjusting valve based on a detection value of the temperature sensor and controlling a temperature of the refrigerant gas discharged from the screw compressor.

With the above configuration (9), since the first controller controls the opening degree of the flow-rate adjusting valve disposed on the refrigerant liquid supply line based on the detection value of the temperature sensor, it is possible to control the discharge gas temperature. Thus, it is possible to improve control accuracy of the discharge gas temperature.

(10) In an embodiment, in the above configuration (8), the movable portion is constituted by a valve body of an internal volume ratio variable control valve capable of controlling an internal volume ratio of a refrigerant gas sucked into the rotor casing, and the refrigeration device further includes a temperature sensor detecting a temperature of a refrigerant gas discharged from the screw compressor, a pressure sensor detecting a pressure of the refrigerant gas discharged from the screw compressor, a flow-rate adjustment valve disposed on the refrigerant liquid supply line, and a second controller controlling an opening degree of the flow-rate adjusting valve based on detection values of the temperature sensor and the pressure sensor, and controlling a degree of superheat of the refrigerant gas discharged from the screw compressor.

With the above configuration (10), since the second controller controls the opening degree of the flow-rate adjusting valve disposed on the refrigerant liquid supply line based on the detection values of the temperature sensor and the pressure sensor, it is possible to accurately control the degree of superheat of the discharge gas.

(11) In an embodiment, in any one of the above configurations (8) to (10), the refrigeration device further includes a position sensor detecting a position of the movable portion in the rotor shaft direction, a flow-rate adjustment valve disposed on the refrigerant liquid supply line, and a third controller controlling an opening degree of the flow-rate adjusting valve based on a detection value of the position sensor.

With the above configuration (11), the third controller can detect the internal volume ratio and a volume control position depending on a position of the movable portion in the rotor shaft direction detected by the above-described position sensor. Then, the third controller controls the opening degree of the above-described flow-rate adjusting valve to set an optimum liquid injection amount for the detected internal volume ratio and the volume, making it possible to accurately control the discharge gas temperature and the degree of superheat.

(12) In an embodiment, in any one of the above configurations (8) to (11), the refrigeration device further includes an oil separator separating oil from a refrigerant gas discharged from the screw compressor.

With the above configuration (12), since it is possible to inject the liquid on the side close to the discharge port as described above by disposing refrigerant liquid supply ports in the movable portion, it is possible to efficiently stabilize the discharge gas temperature at a low level. Thus, it is possible to improve separation performance of the oil separator and thus to reduce the size of the oil separator.

(13) In an embodiment, in any one of the above configurations (8) to (12), the refrigeration device further includes a hermetic motor driving the screw compressor, and the refrigerant liquid supply line is introduced to the movable portion via the hermetic motor.

With the above configuration (13), it is possible to use the refrigerant liquid used for liquid injection to cool the hermetic motor as well.

Advantageous Effects

According to some embodiments, it is possible to stably control a discharge gas temperature by adjusting positions of liquefied liquid supply ports in a rotor shaft direction even if operating conditions change, and thus to improve reliability of a screw compressor. In addition, since it is possible to arrange the liquefied liquid supply ports on a discharge side, it is possible to efficiently decrease the discharge gas temperature, to reduce a workload of the compressor, and to improve a COP as compared with a case in which a liquid is injected on a side close to a suction port.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain", and "constitute" are not intended to be exclusive of other components.

Figure 1:
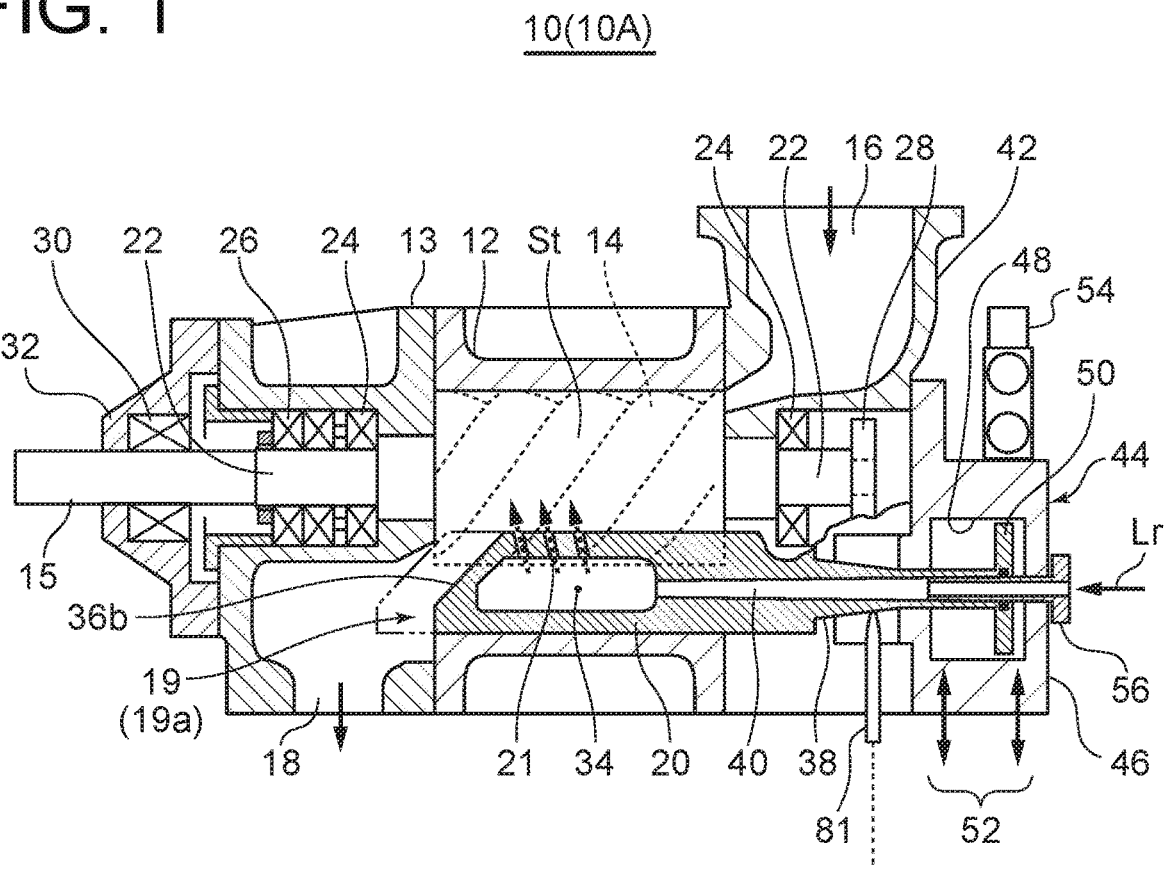
FIG. 1 a vertical cross-sectional view of a screw compressor according to an embodiment.
Figure 2:
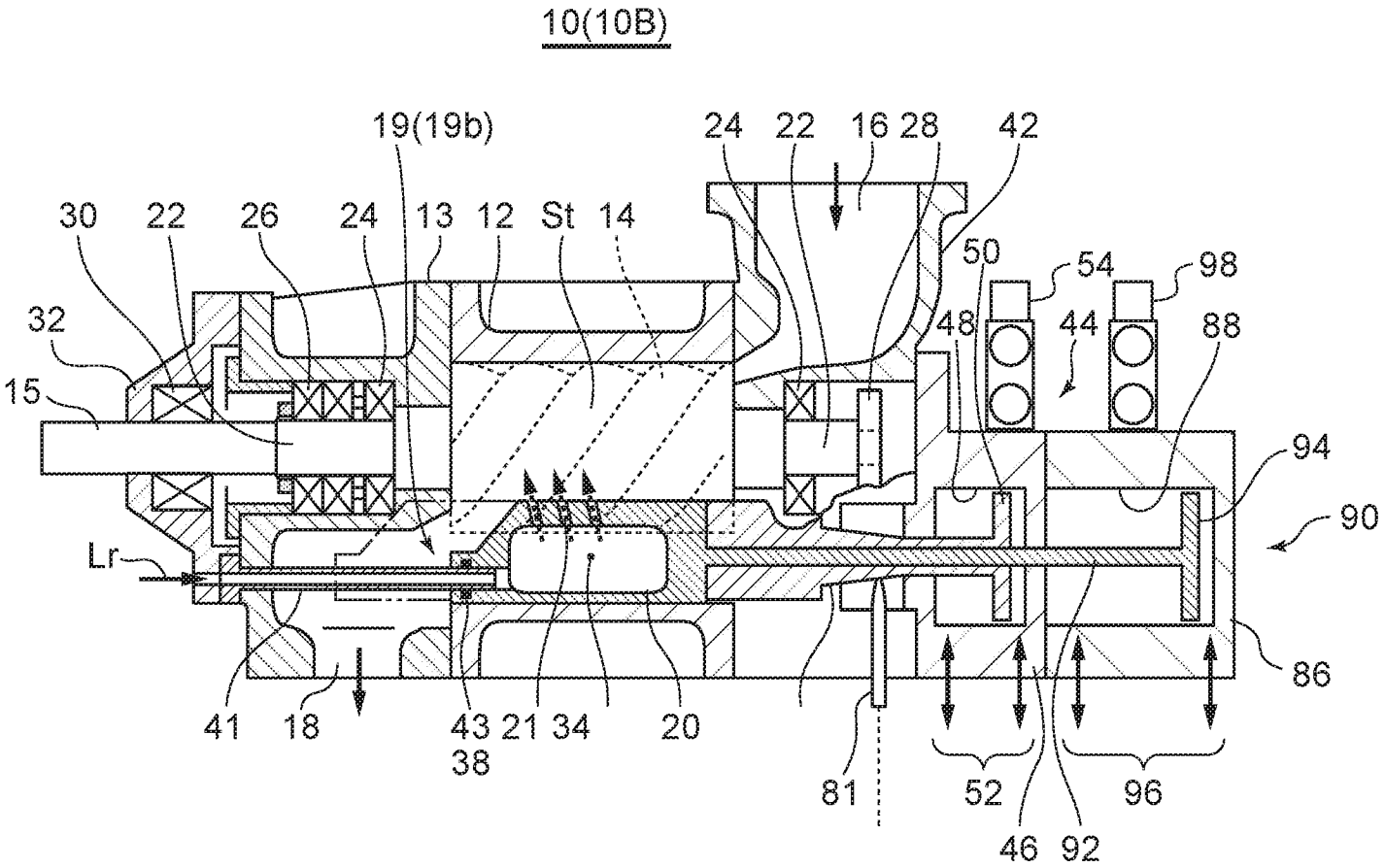
FIG. 2 is a vertical cross-sectional view of the screw compressor according to an embodiment.
Figure 3:
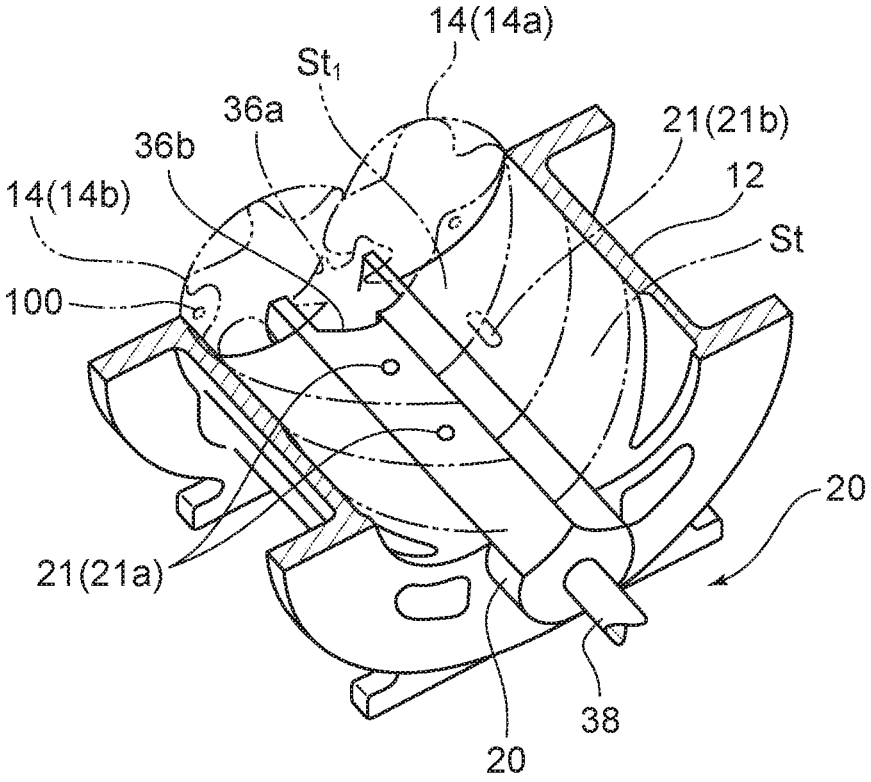
FIG. 3 is a perspective view of a halved rotor casing of the screw compressor shown in FIG. 1.

FIGS. 1 and 2 are vertical cross-sectional views of screw compressor 10 (10A, 10B) according to some embodiments. The screw compressor 10 houses a pair of screw rotors 14 engaging with each other inside a rotor casing 12. As shown in FIG. 3, the pair of screw rotors 14 include a male rotor 14 (14*a*) and a female rotor 14 (14*b*). The pair of screw rotors 14 rotate in mutually opposite directions by, for example, forming a drive shaft 15 integrally with the male rotor on a discharge side and rotating the drive shaft 15 by a drive portion (not shown). Between the rotor casing 12 and the pair of screw rotors 14, a plurality of tooth groove spaces St are formed in a rotor shaft direction. The tooth groove spaces St communicate with a suction port 16 on an inlet side and communicate with a discharge port 18 on an outlet side. The tooth groove spaces St move to the discharge side in accordance with rotations of the screw rotors 14, and are shut off from the suction port 16 when the volume of the tooth groove spaces St becomes maximum. The ratio of the maximum suction volume to the volume of a tooth groove space immediately before communicating with the discharge port 18 will be referred to as an internal volume ratio (maximum suction volume/volume of pre-discharge tooth groove space) Vi.

The screw compressor 10 includes a movable portion 20 disposed so as to be movable in the rotor shaft direction at a position adjacent to the pair of screw rotors 14. The movable portion 20 includes liquefied liquid supply ports 21 capable of supplying a liquefied liquid of a compressed gas toward the tooth groove spaces St.

According to the above configuration, since the liquefied liquid supply ports 21 can move in the rotor shaft direction with the movable portion 20, it is possible to stably control the temperature of a refrigerant gas discharged from the discharge port 18 by adjusting positions of the liquefied liquid supply ports 21 in the rotor shaft direction even if operating conditions change, and thus to improve reliability of the screw compressor 10. In addition, since the movable portion 20 is provided with the liquefied liquid supply ports 21, it is possible to arrange the liquefied liquid supply ports 21 such that they communicate with the tooth groove spaces St on a side which is close to the discharge port 18 and has a high pressure. Thus, it is possible to efficiently decrease the discharge gas temperature, to reduce a workload of the compressor 10, and to improve a COP as compared with a case in which a liquid is injected on a side close to the suction port 16.

In a case where a fixed liquefied liquid supply port is adopted as before, a plurality of liquefied liquid supply ports need to be disposed in the rotor shaft direction in order to change an injection position of a liquefied liquid according to a change in operating conditions. In this case, performance of the compressor 10 and the strength of the rotor casing 12 may be degraded.

In an embodiment, at least one of the liquefied liquid supply ports 21 is arranged to be positioned in a pre-discharge tooth groove space $St_1$ (see FIG. 3), making it possible to enhance the effect of decreasing the discharge gas temperature while suppressing degradation in compressor performance and to enhance the effect of reducing the workload of the screw compressor 10.

In an embodiment, as shown in FIGS. 1 and 2, a rotor shaft 22 of the pair of screw rotors 14 is rotatably supported by a radial bearing 24 and a thrust bearing 26 which are housed in a bearing head 13 disposed on the discharge side adjacent to the rotor casing 12. On the suction-side rotor shaft 22, a balance piston 28 is disposed which corrects unbalance of opposite forces applied to the screw rotors 14 between the suction side and the discharge side. The drive shaft 15 is supported by a shaft seal device 30 and is led out of a casing 32.

In an embodiment, the movable portion 20 internally forms a cavity 34. The liquefied liquid supply ports 21 communicate with the cavity 34 and are formed by through holes opening to the outer peripheral surface of the movable portion 20. According to the present embodiment, since a supply passage for the liquefied liquid supplied to the liquefied liquid supply ports is formed inside the movable portion 20, it is possible to downsize the configuration of the refrigerant liquid supply passage. Moreover, since the liquefied liquid supply ports 21 are formed by the through holes opening to the outer peripheral surface of the movable portion 20, the liquefied liquid supply ports 21 are formed easily.

The screw compressor 10 (10A) shown in FIG. 1 includes an internal volume ratio variable control valve 19 (19*a*) capable of controlling the internal volume ratio of the compressed gas sucked into the rotor casing 12. The variable control valve 19 (19*a*) can set the internal volume ratio Vi variable by changing a position in the rotor shaft direction. The movable portion 20 is constituted by a valve body of the variable control valve 19 (19*a*). As shown in FIG. 3, an axial discharge port 36*a* is formed in the bearing head 13, and a radial discharge port 36*b* is formed at a discharge-side end of the variable control valve 19 (19*a*). The radial discharge port 36*b* restricts a discharge position of the compressed gas.

According to the present embodiment, since the existing variable control valve 19 is used as the movable portion 20, it is unnecessary to install an additional movable portion. Moreover, since the liquefied liquid supply ports 21 are disposed on the valve body of the variable control valve 19, it is possible to set the liquefied liquid supply ports 21 at positions in the rotor shaft direction with the relatively high internal volume ratio having a less influence on the compressor performance while the valve body of the variable control valve 19 is set with the optimum internal volume ratio Vi depending on the operating conditions. Thus, it is possible to stably control the discharge gas temperature while suppressing the degradation in the compressor performance and to improve the cooling effect of the compressed gas.

In an embodiment, as shown in FIG. 2, the screw compressor 10 (10B) includes a volume control slide valve 19 (19*b*) capable of controlling a volume according to the load of the screw compressor 10 (10B). The movable portion 20 is constituted by the slide valve 19 (19*b*).

According to the present embodiment, since it is possible to use the existing volume control slide valve as the movable portion 20, it is unnecessary to install an additional movable portion. Moreover, since the liquefied liquid supply ports 21 are formed in a valve body of the slide valve 19 (19*b*), it is possible to set the liquefied liquid supply ports 21 at discharge-side positions having a less influence on the compressor performance in the rotor shaft direction while the valve body is set at an optimum position for volume control depending on the operating conditions. Thus, it is possible to stably control the discharge gas temperature while suppressing the degradation in the compressor performance and to improve the cooling effect of the compressed gas.

In an embodiment, as shown in FIGS. 1 and 2, the movable portion 20 includes an extending portion 38 which extends outside a casing 42 forming the rotor casing 12, the suction port 16, and the like in the rotor shaft direction. The movable portion 20 is driven by a drive portion 44 via the extending portion 38 in the rotor shaft direction, making it possible to adjust the positions of the movable portion 20 and the liquefied liquid supply ports 21 in the rotor shaft direction.

In the embodiment shown in FIG. 1, the movable portion 20 and the extending portion 38 are formed integrally, and the extending portion 38 internally forms a liquefied liquid introduction space 40. The liquefied liquid introduction space 40 communicates with the cavity 34 and linearly extends in the rotor shaft direction. According to the present embodiment, since it is possible to introduce the liquefied liquid to the cavity 34 formed in the movable portion 20 via the liquefied liquid introduction space 40, it is possible to simplify the configuration of a liquefied liquid introduction path.

In the embodiment shown in FIG. 1, the variable control valve 19 (19*a*) is constituted by an internal volume ratio variable control valve which only controls the internal volume ratio Vi without making volume adjustment on the suction side. Accordingly, the volume of the screw compressor 10 is adjusted by causing the drive portion (not shown) of the pair of screw rotors 14 to control the rotation speed of the screw rotors 14. The internal volume ratio Vi is controlled by causing the drive portion 44 to move the movable portion 20 (the valve body of the variable control valve 19 (19*a*)) in the rotor shaft direction. As the drive portion 44, a cylinder portion 48 is formed inside a casing 46 disposed to be connected to the casing 42, and the cylinder portion 48 includes a built-in hydraulic piston 50 disposed on the end part of the extending portion 38.

The hydraulic piston 50 is driven in the rotor shaft direction by supplying/discharging pressurized oil to the cylinder portion 48 through pressurized oil supply/discharge passages 52. Supply/discharge of the pressurized oil is controlled by an electromagnetic valve 54. A connection pipe 56 is connected to the end part of the extending portion 38 from the outside of the casing 46, and a liquefied liquid Lr is supplied to the liquefied liquid introduction space 40 via the connection pipe 56.

In the embodiment shown in FIG. 2, the slide valve 19 (19*b*) is constituted by a volume control slide valve having a variable function for the internal volume ratio Vi. In the slide valve 19 (19*b*), the movable portion 20 and the extending portion 38 are formed independently of each other. The slide valve 19 (19*b*) controls the internal volume ratio Vi by causing the drive portion 44 having the same configuration as the embodiment shown in FIG. 1 to move the movable portion 20 (the valve body of the slide valve 19 (19*b*) in the rotor shaft direction. Volume control is performed by a drive portion 90 which is disposed in the casing 86 disposed adjacent to the casing 46. That is, the casing 86 internally forms a cylinder portion 88, and the cylinder portion 88 includes a built-in hydraulic piston 94. A piston rod 92 whose both ends are connected to the movable portion 20 and the hydraulic piston 94 is slidably introduced to a through hole formed at the center of the extending portion 38 in a shaft direction. The hydraulic piston 94 is driven in the rotor shaft direction by supplying/discharging pressurized oil to the cylinder portion 88 through oil supply/discharge passages 96. Supply/discharge of the pressurized oil is controlled by an electromagnetic valve 98. The movable portion 20 thus moves in the rotor shaft direction independently of the extending portion 38, forming a gap between the movable portion 20 and the extending portion 38, and performing volume control.

Further, in the embodiment shown in FIG. 2, the liquefied liquid Lr is introduced to the cavity 34 through a connection pipe 41 disposed in the bearing head 13 in the rotor shaft direction. The end part of the connection pipe 41 is inserted in a through hole penetrating the cavity 34 of the movable portion 20 and a discharge-side surface of the movable portion 20. The other-end opening of the connection pipe 41 opens into the outside of the casing 32, and the liquefied liquid Lr is supplied from the opening. A seal and guide member 43 is disposed between the movable portion 20 and the connection pipe 41.

FIG. 3 internally shows the rotor casing of the screw compressor 10 (10A) shown in FIG. 1. Inside the rotor casing 12, the pair of male rotor 14 (14*a*) and female rotor 14 (14*b*) are arranged to engage with each other.

In an embodiment, the plurality of liquefied liquid supply ports 21 (21*a*) are formed in the movable portion 20 in the rotor shaft direction. According to the present embodiment, since the liquefied liquid is injected from a plurality of parts dispersed in the rotor shaft direction, it is possible to ensure a liquid supply amount needed to cool the compressed gas which is compressed and increased in temperature, and to uniformly cool the compressed gas in the rotor shaft direction. Moreover, impact waves such as liquid hammers generated by injecting the liquefied liquid are dispersed, making it possible to mitigate an impact force thereof. It is also possible to maintain a liquid injection function even if some of the liquefied liquid supply ports 21 are clogged. The compressed gas contains refrigerator oil if the screw compressor 10 is incorporated in the refrigeration device.

In an embodiment, as shown in FIG. 3, the plurality of liquefied liquid supply ports 21 (21*a*) are arranged toward at least the pre-discharge tooth groove space $St_1$ and the tooth groove space St adjacent to the pre-discharge tooth groove space $St_1$ of the plurality of tooth groove spaces St formed by the pair of screw rotors 14.

According to the present embodiment, since it is possible to inject the liquefied liquid into each tooth groove space closest to the discharge port of the plurality of tooth groove spaces St, it is possible to control the discharge gas temperature more stably and to improve the effect of cooling the compressed gas on the discharge side.

For example, as illustrated in the drawing, the plurality of liquefied liquid supply ports 21 can each be formed by a through hole which has a transverse cross-section of a circular shape, an oval shape, or the like formed on a partition wall of the rotor casing 12 and opening into the inner surface of the rotor casing 12. Thus, the liquefied liquid supply ports 21 are formed easily.

In an embodiment, as shown in FIG. 3, as a replacement for the plurality of liquefied liquid supply ports 21 (21*a*), the liquefied liquid supply port 21 is formed by a through hole having a long hole transverse cross-section whose long sides are directed in the rotor shaft direction and opening into the inner surface of the rotor casing 12. The liquefied liquid supply port 21 (21*b*) can open over the two adjacent tooth groove spaces St when the plurality of tooth groove spaces St move in the rotor shaft direction, making it possible to perform the same liquid injection as in a case in which the through hole is formed in each tooth groove space of the plurality of tooth groove spaces St.

In FIG. 3, a liquefied liquid supply port 100 shows an example of a conventional liquefied liquid supply port formed at a fixed site which is the end surface of the bearing head 13. The liquefied liquid supply port 100 is illustrated to be compared with the liquefied liquid supply ports 21 (21*a*, 21*b*) according to the embodiment.

Although FIG. 3 shows the embodiment in which the screw compressor 10 (10A) with the variable control valve 19 (19*a*) includes the liquefied liquid supply ports 21 (21*a*, 21*b*), the screw compressor 10 (10B) with the slide valve 19 (19*b*) can also include the liquefied liquid supply ports 21 (21*a*, 21*b*).

Figure 4:
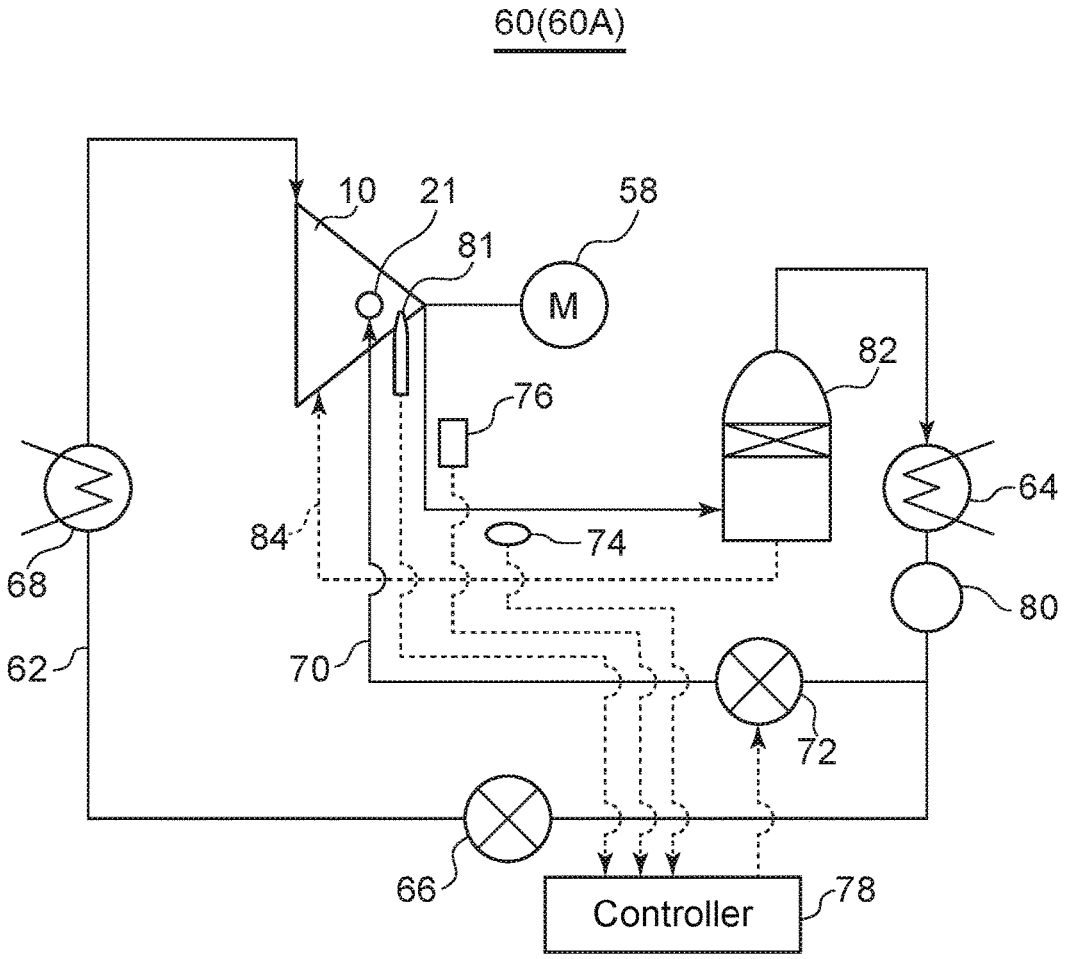
FIG. 4 is a system diagram of a refrigeration device according to an embodiment.

As shown in FIG. 4, a refrigeration device 60 (60A) according to an embodiment is configured to include, on a refrigerant circulation line 62, the screw compressor 10 having the above-described configuration and other refrigeration cycle constituting devices. The other refrigeration cycle constituting devices mainly include a condenser 64, an expansion valve 66, an evaporator 68, and the like. The drive shaft 15 of the screw compressor 10 is rotary driven by a drive portion 58. The refrigeration device 60 (60A) also includes a refrigerant liquid supply line 70 for supplying a refrigerant liquid liquefied by the condenser 64 to the movable portion 20 of the screw compressor 10. The refrigerant liquid is injected into the tooth groove spaces St from the liquefied liquid supply ports 21 formed in the movable portion 20.

According to the above configuration, with the screw compressor 10, it is possible to stably control the discharge gas temperature even if the operating conditions change. In addition, since it is possible to arrange the liquefied liquid supply ports 21 on the tooth groove spaces St on the side which is close to the discharge port and has the high pressure, it is possible to efficiently decrease the discharge gas temperature, to reduce the workload of the compressor, and to improve the COP as compared with the case in which the refrigerant liquid is injected on the side close to the suction port 16.

Figure 5:
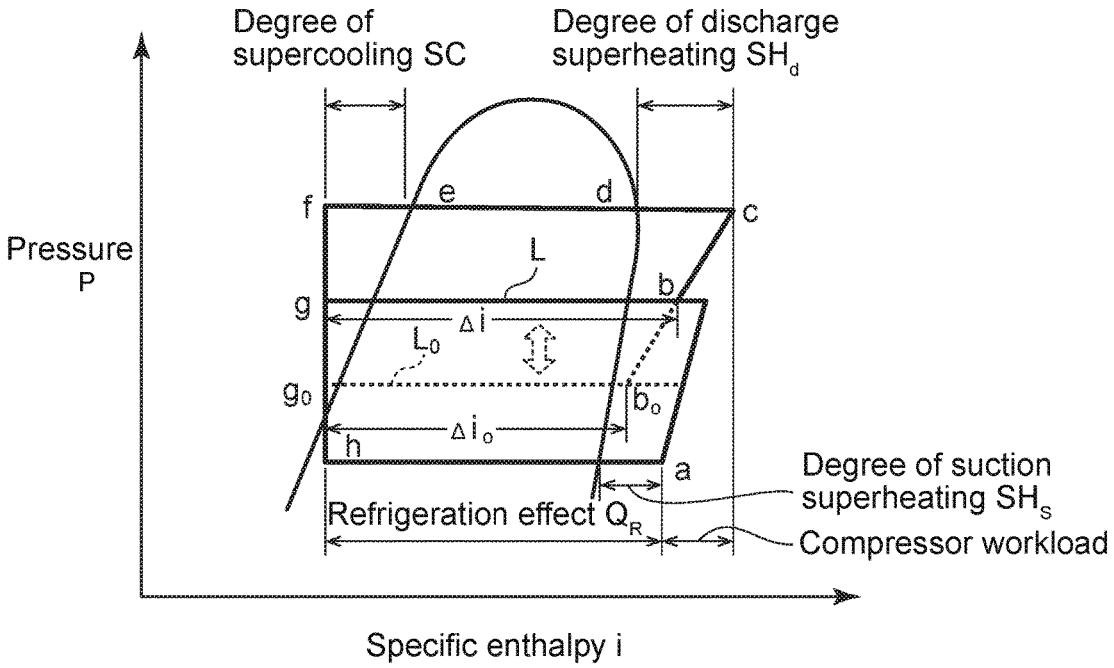
FIG. 5 is a Mollier diagram of the refrigeration device according to an embodiment.
Figure 6:
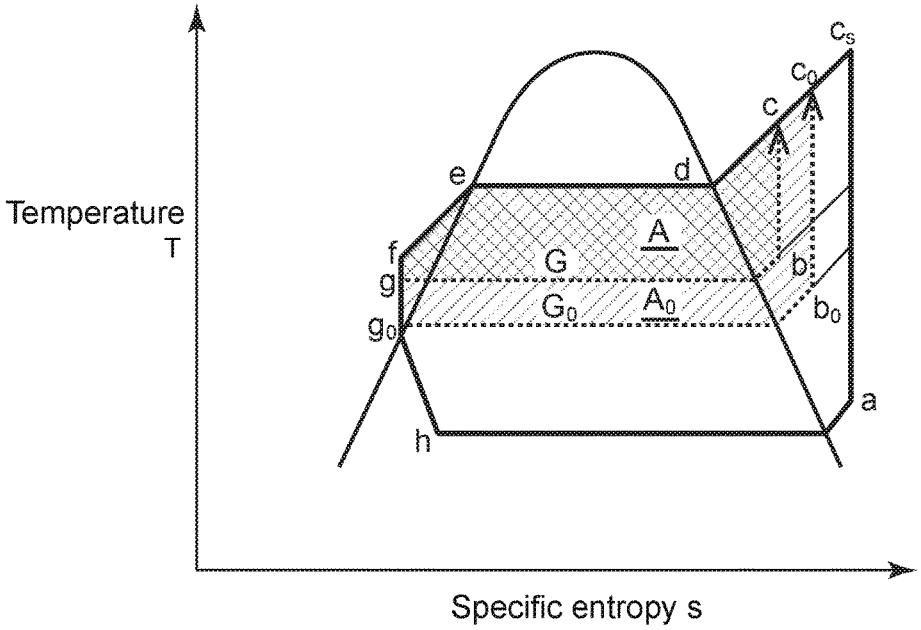
FIG. 6 is a T-s diagram of the refrigeration device according to an embodiment.

FIG. 5 is a Mollier diagram of a refrigeration cycle constituted by the refrigeration device 60 according to an embodiment. FIG. 6 is a T-s diagram of the refrigeration cycle. In FIG. 5, a line $L_0$ is a line indicating conventional fixed refrigerant liquid injection performed at a position close to the suction side of the screw compressor 10, and a line L is a line indicating refrigerant liquid injection according to an embodiment in which the refrigerant liquid is injected from the movable portion 20. Reference symbol Δi indicates a cooling effect of the refrigerant gas according to an embodiment, and reference symbol $\Delta i_0$ indicates a conventional cooling effect of the refrigerant gas. In FIG. 6, a-$c_s$-d-e-f-h-a represents a basic refrigeration cycle. A conventional refrigerant liquid injection cycle is represented by a refrigerant liquid injection line ($b_0$-$c_0$-d-e-f-$g_0$-$b_0$) added to the above-described basic refrigeration cycle, and a discharge gas temperature $c_0$ is obtained. The refrigerant liquid injection cycle has an area $A_0$ which corresponds to a workload per unit of a liquid amount added to the basic refrigeration cycle. A position-variable refrigerant liquid injection cycle according to an embodiment is represented by a refrigerant liquid injection line (b-c-d-e-f-g-b) added to the above-described basic refrigeration cycle, and a discharge gas temperature c is obtained. In this case, the refrigerant liquid injection cycle has an area A which corresponds to a workload per unit of a liquid amount added to the basic refrigeration cycle. As can be seen in FIG. 6, a workload increased by liquid injection according to an embodiment is in the relation of the area A×a liquid injection amount G<the area $A_0$×a liquid injection amount $G_0$.

According to the position-variable refrigerant liquid injection cycle according to an embodiment, since it is possible to inject the refrigerant liquid from a position having the higher internal volume ratio Vi than before, it is possible to cool the discharge gas to a temperature lower than before, and to reduce a wasteful workload (power) of the screw compressor 10 if the liquid supply amount is the same.

In an embodiment, as shown in FIG. 4, a temperature sensor 74 detecting the temperature of the refrigerant gas discharged from the screw compressor 10 is provided on the discharge-side refrigerant circulation line 62 of the screw compressor 10. A flow-rate adjusting valve 72 is provided on the refrigerant liquid supply line 70. A detection value of the temperature sensor 74 is input to a controller 78. The controller 78 controls the opening degree of the flow-rate adjusting valve 72 based on the detection value. Thus, it is possible to improve control accuracy of the discharge gas temperature.

In an embodiment, a refrigerant liquid tank 80 is provided downstream of the condenser 64 on the refrigerant circulation line 62, and the refrigerant liquid liquefied by the condenser 64 is sent downstream of the refrigerant circulation line 62 or the refrigerant liquid supply line 70 after once being stored in the refrigerant liquid tank 80.

In an embodiment, as shown in FIG. 4, a pressure sensor 76 detecting the pressure of the refrigerant gas discharged from the screw compressor 10 is provided on the refrigerant circulation line 62 on the discharge side of the compressor. The controller 78 receives a detection value of the pressure sensor 76. The controller 78 calculates a degree of superheat SH of a compressor discharge gas based on the detection values of the temperature sensor 74 and the pressure sensor 76. The controller 78 controls the opening degree of the flow-rate adjusting valve 72 disposed on the refrigerant liquid supply line 70 so as to appropriately control the degree of superheat SH. Thus, it is possible to accurately control the degree of superheat SH of the compressor discharge gas to an appropriate value.

In an embodiment, the refrigeration device 60 (60A) further includes a position sensor 81 detecting the position of the movable portion (valve body) 20 in the rotor shaft direction. The controller 78 controls the opening degree of the flow-rate adjusting valve 72 based on a detection value of the position sensor 81.

According to the present embodiment, the controller 78 can obtain the internal volume ratio Vi depending on the position of the movable portion 20 in the rotor shaft direction detected by the position sensor 81. Then, the controller 78 can accurately control the discharge gas temperature and the degree of superheat SH by controlling the opening degree of the flow-rate adjusting valve 72 to set an optimum refrigerant liquid injection amount for the obtained internal volume ratio Vi.

In an embodiment, the outer surface of the extending portion 38 where the position sensor 81 is disposed forms an internal volume ratio position detection portion having a tapered surface oblique with respect to the rotor shaft direction. The position sensor 81 is arranged so as to contact the tapered surface. The position of the extending portion 38 in the rotor shaft direction is detected at a position of the position sensor 81 in a direction orthogonal to the rotor shaft direction.

In an embodiment, in place of the refrigerant liquid supply line 70 including the flow-rate adjusting valve 72, it is also possible to provide a first refrigerant liquid supply line including an orifice and a second refrigerant liquid supply line including an electromagnetic valve. Thus, it is possible to make a flow rate adjustment unit disposed on the refrigerant liquid supply line simple and less expensive.

In an embodiment, as shown in FIG. 4, an oil separator 82 is provided on the refrigerant circulation line 62 on the discharge side of the screw compressor 10. The oil separator 82 separates oil from the refrigerant gas discharged from the screw compressor 10. The separated oil is returned to the screw compressor 10 from an oil circulation line 84 as refrigerator oil.

According to the present embodiment, since it is possible to inject the liquid on the side close to the discharge port 18 as described above by disposing the liquefied liquid supply ports 21 in the movable portion 20, it is possible to efficiently stabilize the discharge gas temperature at a low level. Thus, it is possible to decrease a steam pressure of oil entrained by the discharge gas, making it possible to improve separation performance of the oil separator 82 and to reduce the size of the oil separator 82.

The oil separator 82 and the oil circulation line 84 are not installed in an embodiment in which the screw compressor 10 is not an oil-cooled compressor.

Figure 7:
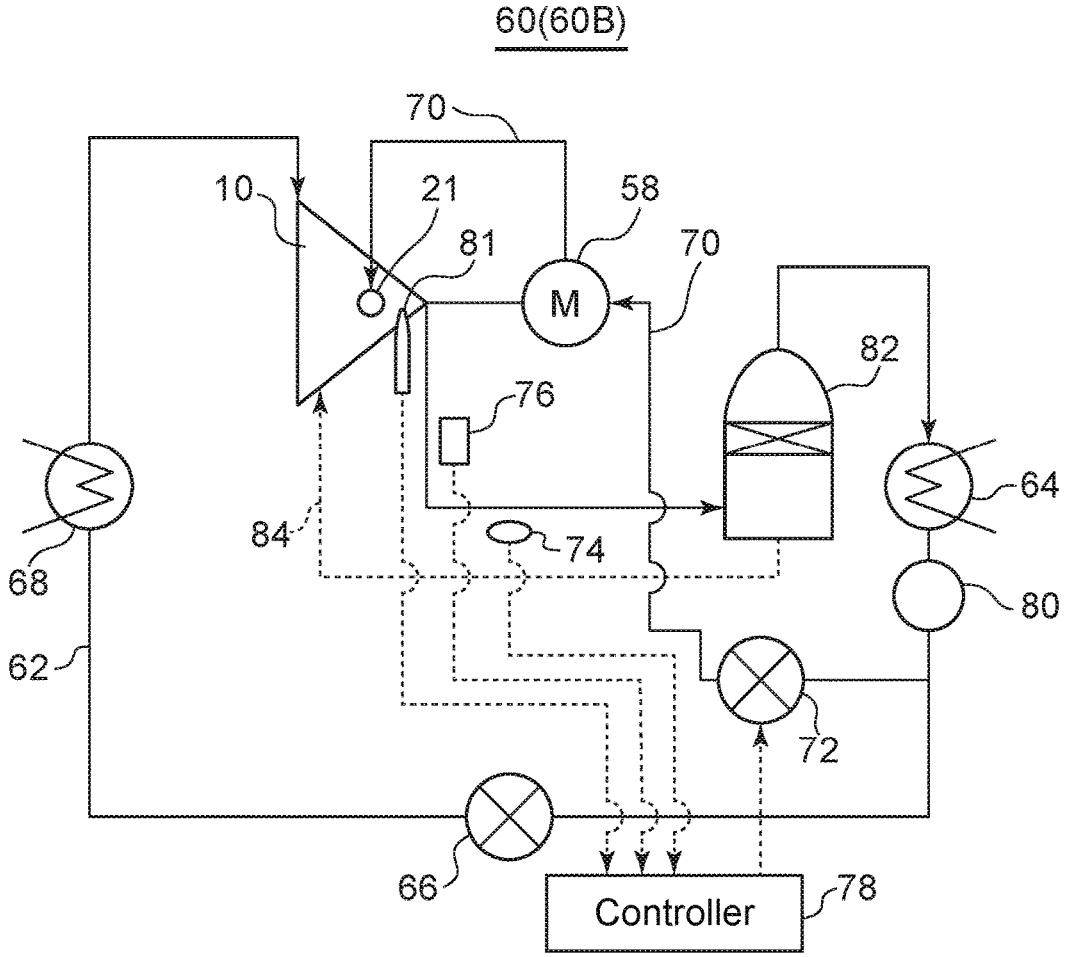
FIG. 7 is a system diagram of the refrigeration device according to an embodiment.

In an embodiment, the refrigeration device 60 (60B) shown in FIG. 7 includes a hermetic motor as the drive portion 58 driving the screw compressor 10. The refrigerant liquid supply line 70 is introduced to the movable portion 20 via the hermetic motor. The refrigerant liquid discharged from the flow-rate adjusting valve 72 is first introduced to the hermetic motor to cool the hermetic motor. In this case, for example, an introducing path for the refrigerant liquid is introduced to the inside of a casing with an enclosed structure of the hermetic motor to enhance the cooling effect. The liquefied liquid after cooling the hermetic motor is sent to the movable portion 20 and injected into the tooth groove spaces St from the liquefied liquid supply ports 21. According to the present embodiment, it is possible to use the refrigerant liquid used for liquid injection to cool the hermetic motor as well.

INDUSTRIAL APPLICABILITY

According to some embodiments, in a screw compressor, it is possible to stably control a discharge gas temperature by adjusting positions of liquefied liquid supply ports in a rotor shaft direction even if operating conditions change. It is also possible to efficiently decrease the discharge gas temperature, to reduce a workload of a compressor, and to improve a coefficient of performance of a refrigeration device in which the screw compressor is incorporated.

REFERENCE SIGNS LIST

10 (10A, 10B) Screw compressor
12 Rotor casing
13 Bearing head
14 Screw rotor
14 (14*a*) Male rotor
14 (14*b*) Female rotor
15 Drive shaft
16 Suction port
18 Discharge port
19 (19*a*) Internal volume ratio variable control valve
19 (19*b*) Volume control slide valve
20 Movable portion (valve body)
21 (21*a*, 21*b*), 100 Liquefied liquid supply port
22 Rotor shaft
24 Radial bearing
26 Thrust bearing
28 Balance piston
30 Shaft seal device
32, 42, 46, 86 Casing
34 Cavity
36*a* Axial discharge port
36*b* Radial discharge port
38 Extending portion
40 Liquefied liquid introduction space
41, 56 Connection pipe
44, 58, 90 Drive portion
48, 88 Cylinder portion
50, 94 Hydraulic piston
52, 96 Pressurized oil supply/discharge passage
54, 98 Electromagnetic valve
56 Connection pipe
60 (60A, 60B) Refrigeration device
62 Refrigerant circulation line
64 Condenser
66 Expansion valve
68 Evaporator
70 Refrigerant liquid supply line
72 Flow-rate adjusting valve
74 Temperature sensor
76 Pressure sensor
78 Controller
80 Refrigerant liquid tank
81 Position sensor
85 Oil separator
84 Oil circulation line
92 Piston rod
G, $G_0$ Liquid injection amount
L Variable refrigerant circulation line
$L_0$ Fixed refrigerant circulation line (conventional)
Lr Liquefied liquid
St Tooth groove space
$St_1$ Pre-discharge tooth groove space

The invention claimed is:

1. A screw compressor comprising:
a rotor casing;
a pair of screw rotors disposed in the rotor casing and engaging with each other;
a movable portion disposed so as to be movable in a rotor shaft direction of the pair of screw rotors, the movable portion including liquefied liquid supply ports configured to supply a liquefied liquid of a compressed gas toward tooth groove spaces formed by the pair of screw rotors; and
a refrigerant liquid supply line having (i) a first end connected to a refrigerant circulation line on which the screw compressor, a condenser, an expansion valve, and an evaporator are disposed and (ii) a second end communicable with the liquified liquid supply ports, the refrigerant liquid supply line being configured to extract liquefied liquid from the refrigerant circulation line and supply the extracted liquefied liquid to the liquefied liquid supply ports,
wherein the first end of the refrigerant liquid supply line is connected to the refrigerant circulation line at a position between the condenser and the expansion valve.

2. A refrigeration device comprising:
the refrigerant circulation line; and
a refrigeration cycle constituting device including the screw compressor according to claim 1 and the condenser disposed on the refrigerant circulation line.

3. The refrigeration device according to claim 2,
wherein the movable portion is constituted by a valve body of a volume control slide valve or an internal volume ratio variable control valve configured to control an internal volume ratio of a refrigerant gas sucked into the rotor casing, and
wherein the refrigeration device further comprises:
a temperature sensor detecting a temperature of a refrigerant gas discharged from the screw compressor;
a flow-rate adjusting valve disposed on the refrigerant liquid supply line; and
a first controller controlling an opening degree of the flow-rate adjusting valve based on a detection value of the temperature sensor and controlling a temperature of the refrigerant gas discharged from the screw compressor.

4. The refrigeration device according to claim 2,
wherein the movable portion is constituted by a valve body of a volume control slide valve or an internal volume ratio variable control valve configured to control an internal volume ratio of a refrigerant gas sucked into the rotor casing, and
wherein the refrigeration device further comprises:
a temperature sensor detecting a temperature of a refrigerant gas discharged from the screw compressor;
a pressure sensor detecting a pressure of the refrigerant gas discharged from the screw compressor;
a flow-rate adjustment valve disposed on the refrigerant liquid supply line; and
a second controller controlling an opening degree of the flow-rate adjusting valve based on detection values of the temperature sensor and the pressure sensor, and controlling a degree of superheat of the refrigerant gas discharged from the screw compressor.

5. The refrigeration device according to claim 2, further comprising:
a position sensor detecting a position of the movable portion in the rotor shaft direction;
a flow-rate adjusting valve disposed on the refrigerant liquid supply line; and
a third controller controlling an opening degree of the flow-rate adjusting valve based on a detection value of the position sensor.

6. The refrigeration device according to claim 2, further comprising an oil separator separating oil from a refrigerant gas discharged from the screw compressor.

7. The refrigeration device according to claim 2, further comprising a hermetic motor driving the screw compressor, wherein the refrigerant liquid supply line is introduced to the movable portion via the hermetic motor.

8. A screw compressor comprising:

a rotor casing;

a pair of screw rotors disposed in the rotor casing and engaging with each other;

a movable portion disposed so as to be movable in a rotor shaft direction of the pair of screw rotors, the movable portion including liquefied liquid supply ports configured to supply a liquefied liquid of a compressed gas toward tooth groove spaces formed by the pair of screw rotors;

a refrigerant liquid supply line having (i) a first end connected to a refrigerant circulation line on which the screw compressor, a condenser, an expansion valve, and an evaporator are disposed and (ii) a second end communicable with the liquified liquid supply ports, the refrigerant liquid supply line being configured to extract liquefied liquid from the refrigerant circulation line and supply the extracted liquefied liquid to the liquefied liquid supply ports;

a position sensor configured to detect a position of the movable portion in the rotor shaft direction;

a flow-rate adjusting valve being disposed on the refrigerant liquid supply line and configured to adjust an amount of the extracted liquefied liquid supplied toward the tooth groove spaces; and a controller configured to control an opening degree of the flow-rate adjusting valve based on a detection result of the position sensor.

9. The screw compressor according to claim 8, wherein the movable portion internally forms a cavity, and wherein the liquefied liquid supply ports communicate with the cavity and are formed by through holes opening to an outer peripheral surface of the movable portion.

10. The screw compressor according to claim 9, wherein the movable portion includes an extending portion extending outside the rotor casing in the rotor shaft direction, wherein the screw compressor further comprises a drive portion driving the movable portion via the extending portion in the rotor shaft direction, and wherein the extending portion internally forms a liquefied liquid introduction space communicating with the cavity and linearly extending in the rotor shaft direction.

11. The screw compressor according to claim 9, wherein the cavity is configured to store the liquefied liquid in a liquid phase.

12. The screw compressor according to claim 9, wherein the movable portion includes:

a first portion having the cavity; and a second portion having a liquefied liquid introduction passage communicating with the cavity and linearly extending in the rotor shaft direction.

13. The screw compressor according to claim 8, further comprising an internal volume ratio variable control valve configured to control an internal volume ratio of the compressed gas sucked into the rotor casing, wherein the movable portion is constituted by a valve body of the internal volume ratio variable control valve.

14. The screw compressor according to claim 8, further comprising a volume control slide valve, wherein the movable portion is constituted by a valve body of the volume control slide valve.

15. The screw compressor according to claim 8, wherein the plurality of liquefied liquid supply ports are arranged in the rotor shaft direction.

16. The screw compressor according to claim 15, wherein the plurality of liquefied liquid supply ports are arranged toward at least a pre-discharge tooth groove space and a tooth groove space adjacent to the pre-discharge tooth groove space of the plurality of tooth groove spaces formed by the pair of screw rotors.

* * * * *